United States Patent [19]

Gamberini

[11] Patent Number: 4,707,028

[45] Date of Patent: Nov. 17, 1987

[54] ADJUSTABLE CHAIR

[75] Inventor: Gino Gamberini, Toscanella Di Dozza, Italy

[73] Assignee: C.O.M. Cooperativa Operai Mobilieri S.C.R.L., Italy

[21] Appl. No.: 885,958

[22] Filed: Jul. 15, 1986

[30] Foreign Application Priority Data

Jul. 18, 1985 [IT] Italy ..... 3506 A/85

[51] Int. Cl.[4] ..... A47C 3/00

[52] U.S. Cl. ..... 297/300; 297/285; 297/312

[58] Field of Search ..... 297/337, 312, 313, 300, 297/285, 304

[56] References Cited

U.S. PATENT DOCUMENTS 4,321,053 6/1985 Boer ..... 297/312
4,375,301 3/1983 Pergler et al. ..... 297/313
4,390,206 6/1983 Faiks et al. ..... 297/300

FOREIGN PATENT DOCUMENTS 2810276 9/1979 Fed. Rep. of Germany ..... 297/300

*Primary Examiner*—James T. McCall
*Attorney, Agent, or Firm*—Popper, Bobis & Jackson

[57] ABSTRACT

An adjustable chair is described comprising a body supported by a base and having a frame constituted by two parts and hingedly connected together.

The main characteristic of the present invention lies in the fact that it includes a mechanism having a first body hinged about a pin rigidly connected to the base and having its front end rigidly connected to the part associated with the seat, and a second body and having a rear end fixed to the part associated with the seat back and a front end connected, by spring means, to a central portion of the said first body.

11 Claims, 5 Drawing Figures

ADJUSTABLE CHAIR

The present invention relates to an adjustable chair.

SUMMARY OF THE INVENTION

The object of the present invention is that of providing an adjustable chair which is of simple construction and reduced production costs.

According to the present invention there is provided an adjustable chair comprising a body supported by a base and having a frame which defines, with a first part, a seat and, with a second part, a seat back of the said body, characterised by the fact that it includes a mechanism having a first body pivoted about a first pin rigidly connected to the said base and having its front end rigidly connected to the said first part, and a second body having a rear end fixed to the said second part and a front end connected, by spring means, to a central portion of the said first body; the said first and second parts being hingedly connected together.

BRIEF DESCRIPTION OF THE DRAWINGS

For a better understanding of the present invention there is now described a preferred embodiment, clearly by way of non-limitative example, with reference to the attached drawings, in which.

DETAILED DESCRIPTION OF THE INVENTION

Figure 1:
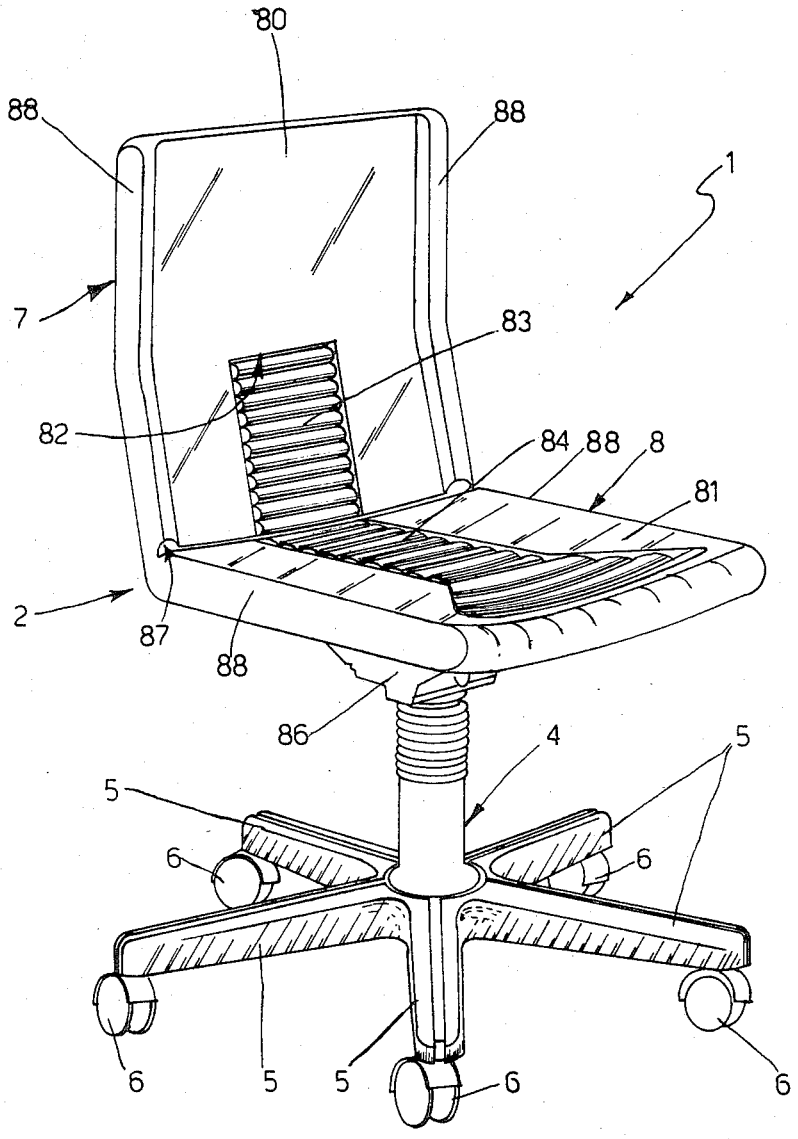
FIG. 1 is a perspective view of an adjustable chair.

As illustrated in FIG. 1, an adjustable chair is generally indicated with the reference numeral 1 and comprises a body 2 having a metal frame 3 (FIG. 2) completely embedded in a layer of polyurethane which will be described better hereinbelow. The body 2 rests on a base 4 of the type having five radial arms 5 to the free ends of which are fixed respective wheels 6. The body 2 is defined by a seat back 7 and a seat 8 which can assume a respective inclination according to the position assumed by the user. The chair 1 can be adjusted in dependence on the fundamental anthropometric parameters of the user such as height and weight. The chair 1 is able automatically to favor the position assumed by the user in that it includes mechanisms which allow the inclination of the seat back 7 and of the seat 8 and which are actuated by the pressure of the body of the user.

Figure 2:
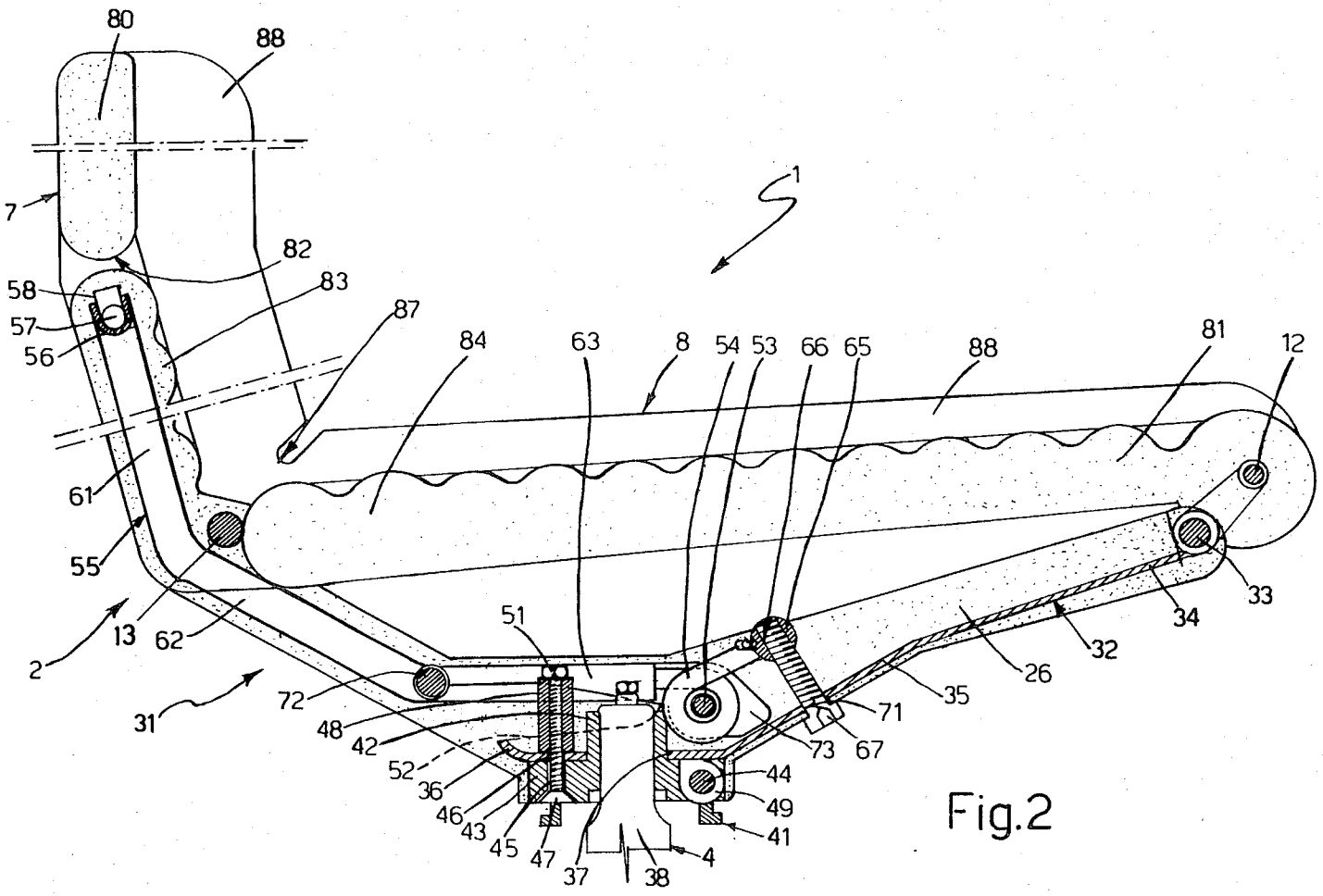
FIG. 2 is a section, on an enlarged scale, of the body of the chair of FIG. 1.
Figure 3:
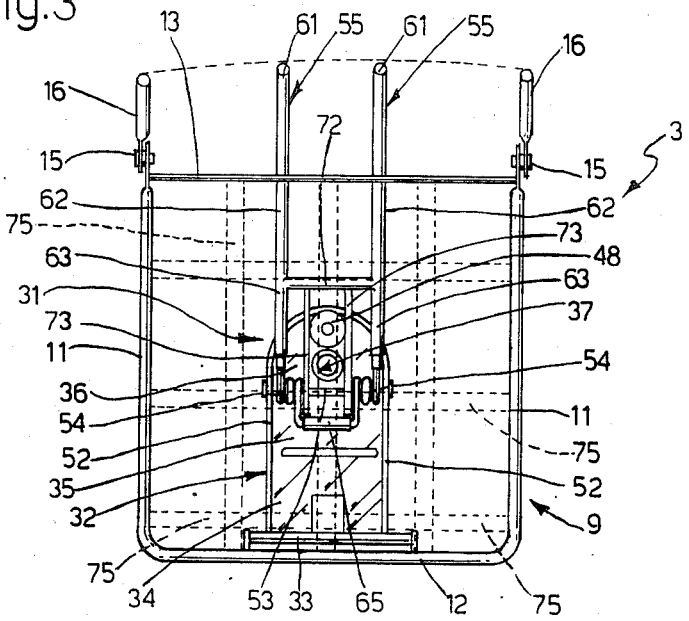
FIGS. 3 and 4 are, respectively, a plan view and a front view of the frame of the body of FIG. 2.
Figure 4:
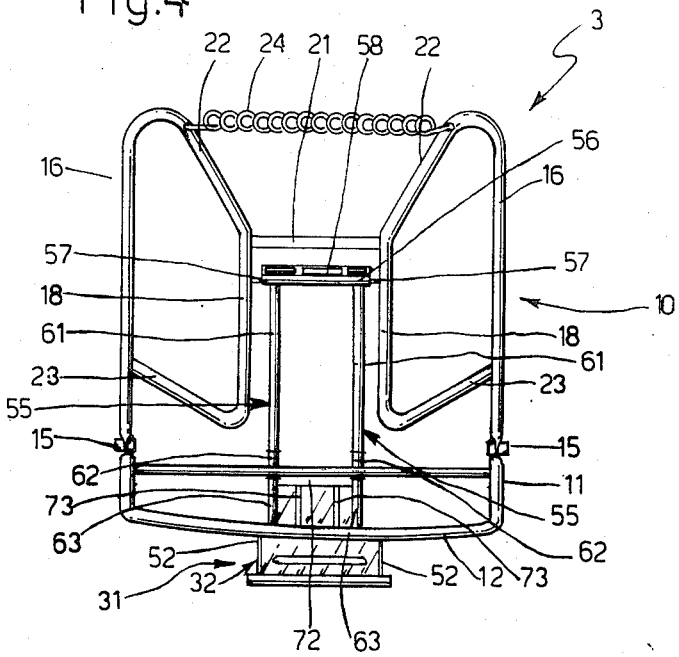

With reference to FIGS. 2, 3 and 4, the part of the frame 3 relating to the seat 8 is indicated by numeral 9 and includes a rod bent into a U in such a way as to define two lateral bars 11 and a front bar 12. The free ends of the bars 11 are connected together by a rear bar 13 parallel to the bar 12. The free ends of the bars 11 are pivoted to a respective pin 15. The part of the frame 3 associated with the seat back 7 is indicated by numeral 10 and comprises two rods folded to form a parallelogram. These rods define a respective outer lateral bar 16, a respective inner lateral bar 18 and two bars 22 and 23 which are, respectively, upper and lower bars, joining the bars 16 and 18, which are parallel to one another. The bar 18 has a length less than that of the bar 16 and the bars 22 and 23 are oblique with respect to the bars 16 and 18. The free ends of the bars 16 are pivoted to the pins 15. The bars 18 are connected together by a bar 21 while the bars 22 are connected together by a spring 24.

As illustrated in FIGS. 2, 3 and 4 a mechanism mounted on the frame 3 is generally indicated 31 and is able to allow the inclination of the seat back 7 and the seat 8. The mechanism 31 comprises a plate 32 having a front end fixed to a bar 33 rigidly connected to the bar 12. A plate 32 has, starting from the bar 33, a first section 34 which extends downwardly, a central second section 35 which also extends downwardly but with a different inclination from that of the section 34, and a third section 36 lying in a plane substantially parallel to the support plane of the chair 1. In the section 36 there is formed a central through hole 37 housing an upper end 38 of the base 4 within which there is mounted, in a manner not illustrated, a gas cylinder by actuating of which one can regulate the longitudinal extension of the base 4 and therefore the height of the body 2 above the support plane. The end 38 of the base 4 engages a sleeve 41 having above and below the plate 32 respective sections 42 and 43. The section 43 supports, close to the junction between the sections 35 and 36 of the plate 32, a small bar 44 the axis of which is parallel to the support plane and to the bar 12. From the section 36 of the plate 32 two pierced projections 49 extend downwardly, by means of which the plate 32 is pivotally connected to the bar 44. The plate 32 can therefore rotate about the axis of the bar 44. The section 43 has an outer diameter greater than that of the section 42. Along the section 43 of the sleeve 41 there is formed a through hole 45 coaxial with the through hole 46 formed in the section 36 of the plate 32. The holes 45 and 46 house a screw 47 the stem of which extends upwardly and out from the hole 46 and lodges in a sleeve 48 formed of resilient material. To the stem of the screw 47 there is screwed a nut 51 which, by means of a washer, compresses the sleeve 48 onto the upper face of the plate 32 which has two lateral projections 52 which extend upwardly. In correspondence with the connection between the sections 35 and 36 there is fixed to the lateral projection 52 a pin 53 around the two ends of which there is wound a respective spring 54. The mechanism 31 further includes two parallel bars 55 having a first end fixed to a U-shape element 56 the concavity of which faces upwardly. From the bars 18 extend respectively pins 57 which lodge in corresponding ends of the element 56. The bars 55 are thus hinged to the pins 57. The element 56 is engaged by a strip 58 of plastics material fixed thereto by means of screws not illustrated. The strip 58 prevents the escape of the pins 57 from the element 56. The bars 55 have a first section 61 positioned between the bars 18, a second section 62 which extends from the first beneath the part 9, and a third section 63 which is parallel to and positioned above the section 36 of the plate 32. At the free ends of the sections 63 there is fixed one end of a corresponding spring 54 a second end of which is folded and housed in a sleeve 65 also housing a second end of the spring 54. The sleeve 65 has an axis parallel to that of the pin 53 and is positioned between the projections 52 extending from the section 35 of the plate 32. The sleeve 65 has a central diametral threaded hole 66 in which is screwed the shank of a screw 67 the head of which rests beneath the section 35 and which extends upwardly through a through hole 71 formed in the section 35. At the junction between the second section 62 and the section 63 of the bars 55 these are connected by bars 72 from which extend two parallel plates 73 which have at their free ends respective holes housing the pin 53. The springs 54 are compressed between a plate 73 and a corresponding projection 52. The part 9 can be provided with a network of elastic belts 75 illustrated in broken outline (FIG. 3). As illustrated in FIGS. 1 and 2, in use, once the frame 3 has been prearranged, the parts 9 and 10 are embedded in respective layers of polyurethane 80 and 81 in such a way as to define together therewith the seat back 7 and the seat 8. The layer of polyurethane 80 of the seat back 7 has a U-shape cut 82 corresponding to the element 56 and to the bars 55. These latter, in correspondence with their first section 61, are embedded in a layer of polyurethane 83 having a plurality of corrugations parallel to the support planes. The layer 81 has a central portion 84 having a plurality of corrugations parallel to those of the layer 83. The portion 84 extends from the bar 13 into the bar 12 and has for a substantial section the same width as the layer 83 and subsequently an increasing width. It is to be noted moreover that the sections 62 and 63 of the bars 55 and the space defined by the plate and by the projections 52 are also embedded in a layer of polyurethane 86 which also covers the lower face of the plate 32 (FIG. 2). The layer 86 is formed as a continuation of the layer 83. Along the whole of the junction between the layers 80 and 81 there is formed an open slot 87. The layers 80 and 81 finally have a lateral edge 88 of greater thickness.

Figure 5:
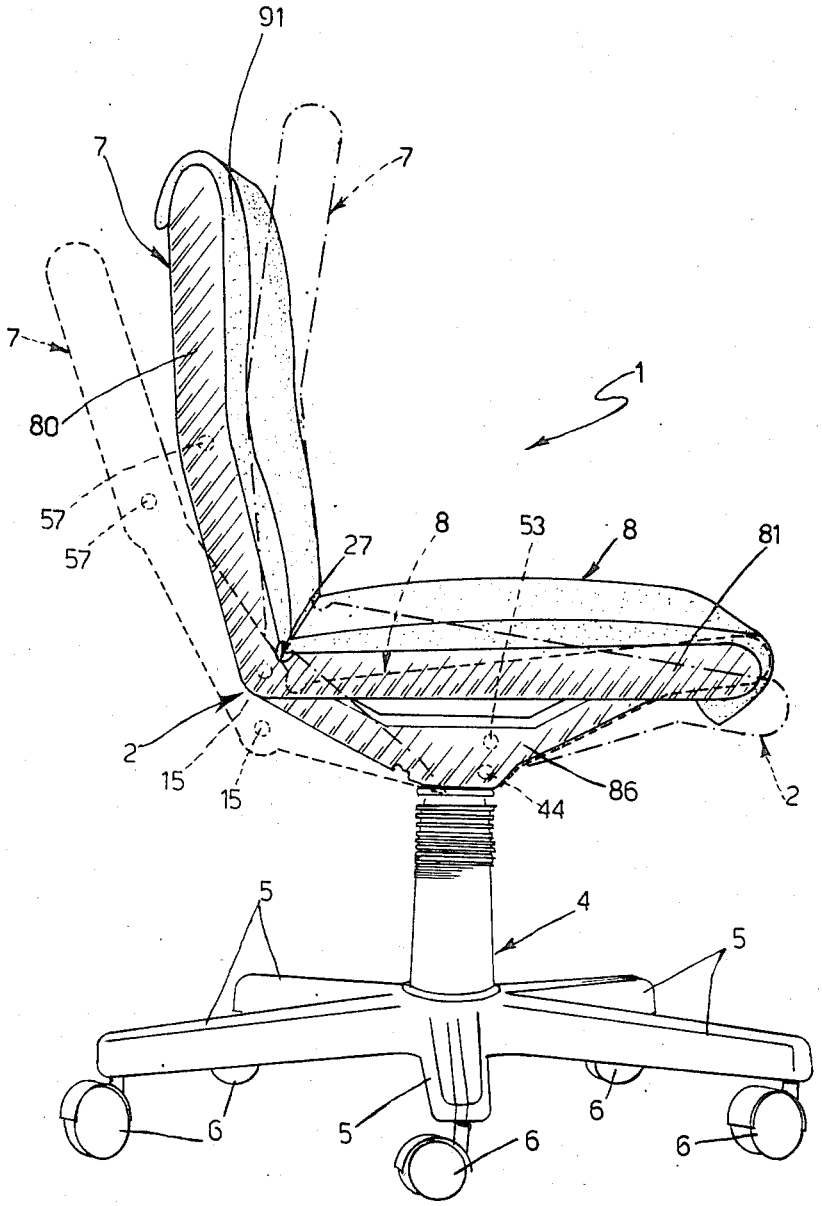
FIG. 5 is a perspective view of the chair of FIG. 1 in which the possible movements thereof are illustrated.

With reference to FIGS. 2–5, the inclination of the seat back 7 and of the seat 8 is a function of the distribution of the weight of the body of the user. In particular, when almost all of the weight of the user is exerted on the seat 8 separating its back from the seat back 7 a rotation of the plate 32 in a clockwise sense takes place about the axis of the bar 44. This rotation causes rotation in a clockwise sense also of the whole of the body 2. The free end of the plate 32 in correspondence with the hole 46 will also turn in a clockwise sense compressing the sleeve 48. As soon as the pressure of the body on the seat 8 ceases, as has just been described, the whole body 2 returns to the original position by the action of the sleeve 48 which presses the free end of the plate 32 downwardly making this latter turn in a clockwise sense. With the back engaging on the seat back 7 rotation of the bar 55 about the axis of the pin 53 takes place by deformation of the springs 54. Finally the seat back 7, and in particular the part 10 of the frame 3, turns about the axes of the pins 57 and draws the pins 15 downwardly with a movement of pantograph type. Consequently this increases the relative angle between the seat 8 and the seat back 7. By means of the screw 67 the springs 54 can be calibrated, that is to say more or less preloaded for the purpose of adjusting the rotation of the bars 55 in relation to the weight of the user. The chair 1 can be provided with a covering 91 (FIG. 5).

The numerous advantages following on the structure of the present invention will be evident. In particular, the chair 1 can be personalised by adjusting the mechanisms 31 (screws 67) in dependence on the weight of the user. Moreover, in dependence on the position assumed, the inclination of the seat back 7 and of the seat 8 which accompanies the body of the user takes place automatically. The mechanism 31 which permits such inclination is of simple construction in that it is formed with a small number of components. It is to be noted that the frame 3 and the mechanism 31 are embedded in polyurethane which forms the aesthetic outline of the chair 1, which for the considerations just explained is of reduced production costs.

Finally, it is clear that the adjustable chair 1 described and illustrated here can have modifications and variations introduced thereto without by this departing from the protective scope of the present invention.

In particular, the chair 1 can be provided with a different base from that illustrated. Such base can be fixed and/or permit rotation of the body 2 about an axis orthogonal to the support plane. Moreover the chair 1 can be provided with a covering. Further, the parts 9 and 10 can have lateral projections in such a way as to be able to widen the body 2 at will starting from a base model of the frame 3. In place of the polyurethane there can be used other resilient and/or deformable materials such as a different plastics material, rubber or a sponge layer.

I claim:

1. An adjustable chair comprising:

a support base;

a chair body including a seat portion a seat back portion; and an inner frame including a lower portion extending along said seat portion, an upper portion extending along said seat back portion, and first hinge means for connecting said lower and upper portions for rotation thereof in relation to one another about a first horizontal axis; and an articulated mechanism connecting said chair body to said support base, said articulated mechanism including first and second resilient means, a first portion extending along a front part of said lower portion of said frame and connected to said lower portion of said frame, a second portion extending along both said upper portion of said frame and a rear part of said lower portion of said frame, second hinge means for connecting a first intermediate point of said first portion to a front end of said second portion of said mechanism for rotation thereof in relation to one another about a second horizontal axis parallel to said first axis and against the action of said first resilient means, third hinge means for connecting a second intermediate point of said first portion and said support base for rotation thereof in relation to one another about a third horizontal axis parallel to said first and second axes and against the action of said second resilient means, and fourth hinge means for connecting said second portion of said mechanism to said upper portion of said frame for rotation thereof in relation to one another about a fourth horizontal axis parallel to said first, second and third axes.

2. A chair according to claim 1; wherein said first and second resilient means are each provided with a respective pre-load adjusting means for adjusting the force applied thereby.

3. A chair according to claim 2; wherein each said pre-load adjusting means comprises an adjustable screw mechanism.

4. A chair according to claim 1; wherein said first portion includes a plate having lateral edges and two first lateral projections extending upwardly from the lateral edges of said plate, said second hinge means includes a first pin supported by said first lateral projections, and said first resilient means includes at least one spring wound onto said first pin and having a first end fixed to said second portion of said mechanism and a second end connected to said plate.

5. A chair according to claim 4; wherein said third hinge means includes a second pin; further comprising a first sleeve having an axis parallel to that of said second pin and having a first diametrical threaded hole, a through hole formed in a central portion of said first portion of said mechanism, and a first screw extending upwardly through said through hole formed in said central portion of said first portion and having a shank screw threadedly received in said diametrical threaded hole; and wherein said second portion of said mechanism includes two first bars having free ends, and said at least one spring of said first resilient means has first ends connected to free ends of said two first bars and second, opposite ends bent over and engaging opposite ends of said first sleeve.

6. A chair according to claim 5; wherein said plate of said first portion includes a rear end portion having a through hole formed therein; further comprising a second sleeve engaged within said through hole in said rear end portion; wherein said base has an upper end rigidly lodged within an interior of said second sleeve, said second pin being supported by said second sleeve, and said rear end portion of said plate having two second laterally pierced projections extending downwardly and housing portions of said second pin, whereby to pivot said plate thereabout.

7. A chair according to claim 6; wherein said second sleeve has a lower portion which supports said second pin and a through hole formed therein; said rear end portion includes a through hole formed close to a free edge thereof and which is coaxial with said through hole of said second sleeve; further comprising a second screw housed within the through holes of said second sleeve and said rear end portion and having a shank extending upwardly and above said through hole in said rear end portion; and wherein said second resilient means includes a third sleeve formed of a resilient material and receiving the shank of said second screw which extends upwardly and above the through hole of said rear end portion, said shank extending through said third sleeve and engaged by a nut which compresses said third sleeve on said rear end portion.

8. A chair according to claim 7; wherein said lower portion of said frame includes a front bar, two third lateral bars connected to free ends of said front bar, and said front bar is rigidly connected to a front end portion of said plate; and said upper portion of said frame includes two fourth outer lateral bars pivotly connected at free ends thereof to free ends of said two third lateral bars and to two fifth lateral inner bars; and said second portion includes a third pin extending from said two fifth lateral inner bars and from which extend said first bars of said second portion, and a U-shaped element which houses said third pin.

9. A chair according to claim 1; wherein said lower and upper portions are embedded in respective first layers of polyurethane.

10. A chair according to claim 9; wherein said first layer in which said upper portion is embedded includes, in correspondence with a connection with the other of said first layers in which said lower portion is embedded, a U-shaped section engaged by an upper part of said second portion of said mechanism, and said first and second portions of said mechanism are embedded in a second layer, a portion of said second layer positioned in correspondence with said U-shaped section having, on its outer face, a plurality of corrugations.

11. A chair according to claim 10; wherein said first layer in which said lower portion is embedded has a central portion having a plurality of corrugations formed thereon parallel to the corrugations formed on the second layer.

* * * * *